US005253897A

United States Patent [19]

Troendle

[11] Patent Number: 5,253,897

[45] Date of Patent: Oct. 19, 1993

[54] BOOK

[76] Inventor: Peter P. Troendle, Sonnwendgasse 22, A-1100 Vienna, Austria

[21] Appl. No.: 793,427

[22] PCT Filed: Jun. 13, 1990

[86] PCT No.: PCT/AT90/00062

§ 371 Date: Dec. 10, 1991

§ 102(e) Date: Dec. 10, 1991

[87] PCT Pub. No.: WO90/15721

PCT Pub. Date: Dec. 27, 1990

[30] Foreign Application Priority Data

Jun. 21, 1989 [AT] Austria ..... 1519/89
Feb. 16, 1990 [AT] Austria ..... 365/90

[51] Int. Cl.[5] ..... B42D 1/00

[52] U.S. Cl. ..... 281/21.1; 281/15.1

[58] Field of Search ..... 281/15.1, 21.1, 46, 281/50

[56] References Cited

U.S. PATENT DOCUMENTS 641,211 1/1900 Lewthwaite ..... 281/21.1
2,355,037 8/1944 Einzig ..... 281/21.1

FOREIGN PATENT DOCUMENTS 3025973 2/1982 Fed. Rep. of Germany .

*Primary Examiner*—Timothy V. Eley
*Assistant Examiner*—Willmon Fridie, Jr.
*Attorney, Agent, or Firm*—Collard & Roe

[57] ABSTRACT

A book comprises a plurality of sheets, each sheet being folded in a zone constituting a back of the book to provide two leaves, at least one first sheet having one of the leaves thereof arranged between the two leaves of a second sheet and the other leaf thereof arranged between the two leaves of a third sheet.

5 Claims, 3 Drawing Sheets

BOOK

BACKGROUND OF THE INVENTION

1. Field of the Invention

The invention relates to a book with a plurality of sheets each comprising two leaves which are folded in the zone of the book back.

2. Description of the Prior Art

Books are known which consist of a plurality of leaves which are sown or glued together at the book back. The term "book" as stated hereinunder shall mean a product comprising a plurality of leaves connected to each other, which also includes booklets, brochures and the like. In known books it is often the case that two leaves form a sheet which is folded in the center. Often several such sheets are stuck within each other, so that the first and the last leaf of a book belong to one sheet, the second and one but last leaf belong to the next sheet and so forth. In order to ensure the cohesion it is necessary to either glue or sow them together. This is expensive and thus limits the possible number of pages in a book. It is possible that a book is compiled from several such partial books, but this solution is also very difficult to achieve.

From the German Patent 682 075 (SCHWENKE) a book is known whose pages are provided with laps which are inserted into respective cut-outs in the cover sheet. In order to ensure coherence, the laps have to be glued.

SUMMARY OF THE INVENTION

It is the object of the present invention to avoid such disadvantages and to create a book which requires no gluing or sowing and which can have an unlimited number of pages.

In accordance with the invention it is therefore provided that at least one sheet is provided whose one leaf is arranged between the two leaves of a further first sheet and whose second leaf is arranged between the two leaves of a second further sheet. The individual sheets interdigitate like the links of a chain. An additional connecting means is not necessary.

Preferably, a first group of sheets is provided, each comprising two cut-outs extending from two opposite edges towards the center of the sheet, and a further group of sheets is provided which comprises in the center a slot-shaped cut-out, each sheet of the first group being insertable into the cut-out of a respective sheet of the second group. When compiling the book, the sheet with the two cut-outs is folded and inserted into the center cut-out.

The production of a book in accordance with the invention is facilitated if a plurality of leaves of other sheets are arranged between the two leaves of a sheet.

An appealing arrangement is achieved if the two outermost leaves each belong to sheets of the second group with a cut-out in the center.

It is particularly advantageous if the cut-outs of the second group of the sheets have the shape of an elongated oval. The individual sheets center themselves by this measure.

BRIEF DESCRIPTION OF THE DRAWING

The invention is now outlined in greater detail by reference to the enclosed drawings, in which.

DESCRIPTION OF THE PREFERRED EMBODIMENTS

Figure 1:
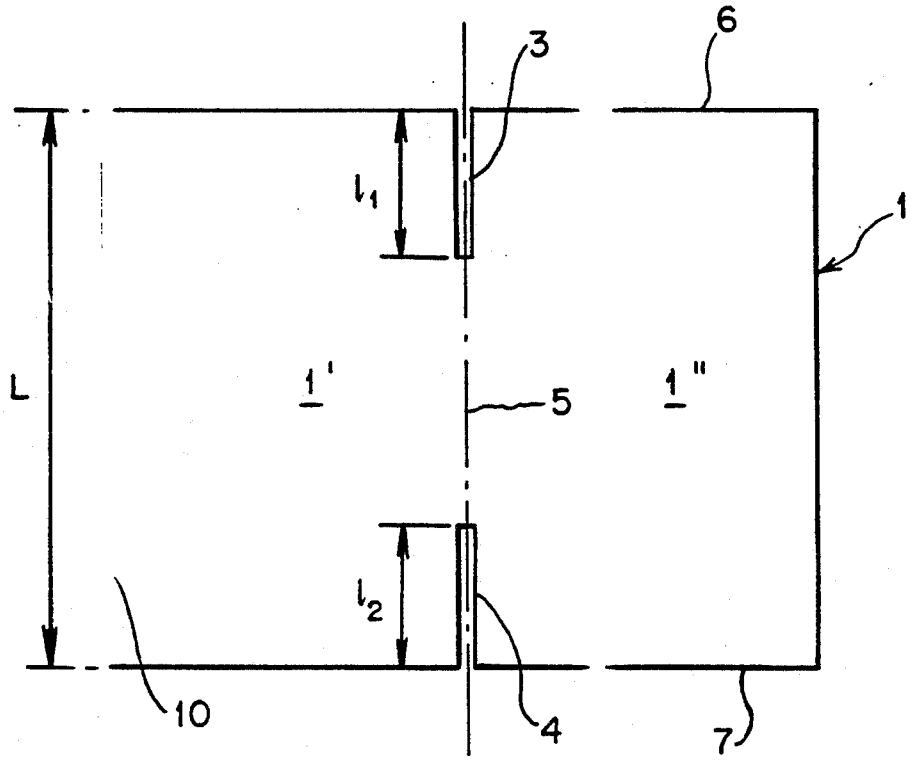
FIG. 1 shows a sheet with two cut-outs.

The sheet 1 shown in FIG. 1 comprises two cut-outs 3 and 4 extending along the axis of symmetry 5 of sheet 1. The cut-outs 3 and 4 start in the center of the edges 6 and 7 of sheet 1 and have lengths $l_1$ and $l_2$. The axis of symmetry 5 divides sheet 1 into leaves 1' and 1''.

Figure 2:
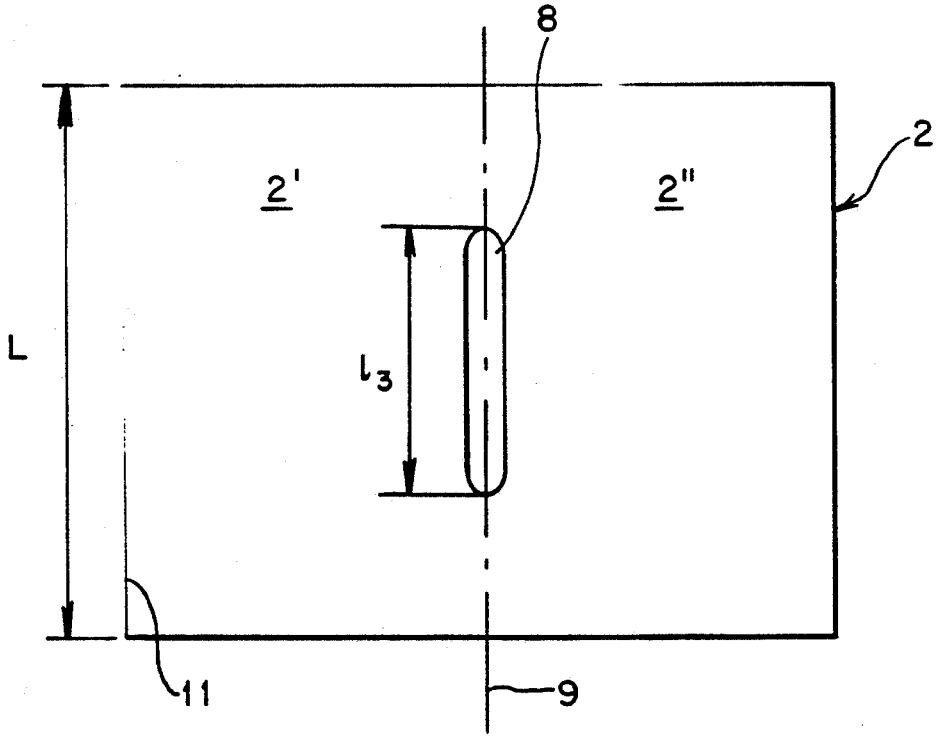
FIG. 2 shows a sheet with a slot-shaped cut-out.

The sheet 2 shown in FIG. 2 comprises a slot-shaped cut-out 8 extending along the axis of symmetry 9. The cut-out 8 has a substantially oval shape and a length $l_3$. The total of lengths $l_1$ and $l_2$ of cut-outs 3 and 4 and the length $l_3$ of the slot-shaped cut-out 8 has to be equal to or slightly greater than the length L of the edges 10 or 11 of sheets 1 or 2 which are parallel to the axis of symmetry 5 or 9. The axis of symmetry 9 divides the sheet 2 into leaves 2' and 2''.

Figure 3:
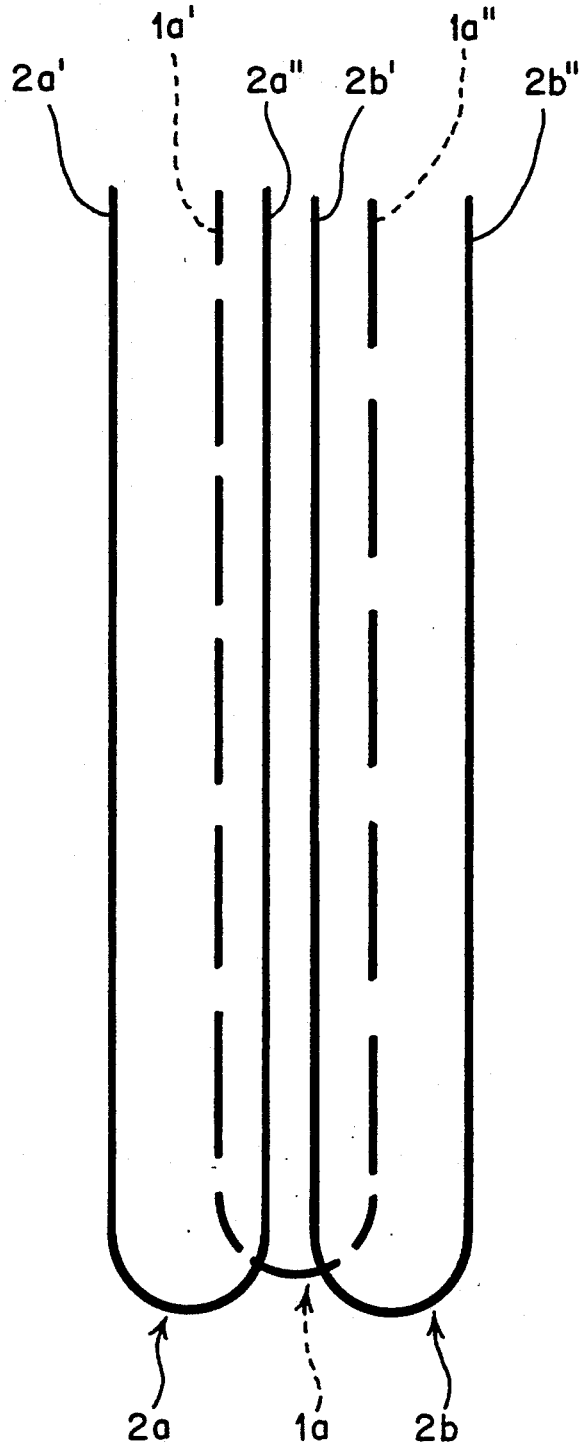
FIGS. 3 and 4 schematically show two embodiments of a book in accordance with the invention.

FIG. 3 shows the minimum arrangement of a book in accordance with the invention. A sheet 1*a*, folded along the axis of symmetry 5 shown in a broken line, holds the sheets 2*a* and 2*b* extending respectively along leaves 1*a'* and 1*a''* of sheet 1*a*. Leaf 1*a'* is inserted between the leaves 2*a'* and 2*a''* of sheet 2*a* and the leaf 1*a''* of sheet 1*a* is inserted between the leaves 2*b'* and 2*b''* of sheet 2*b*.

Figure 4:
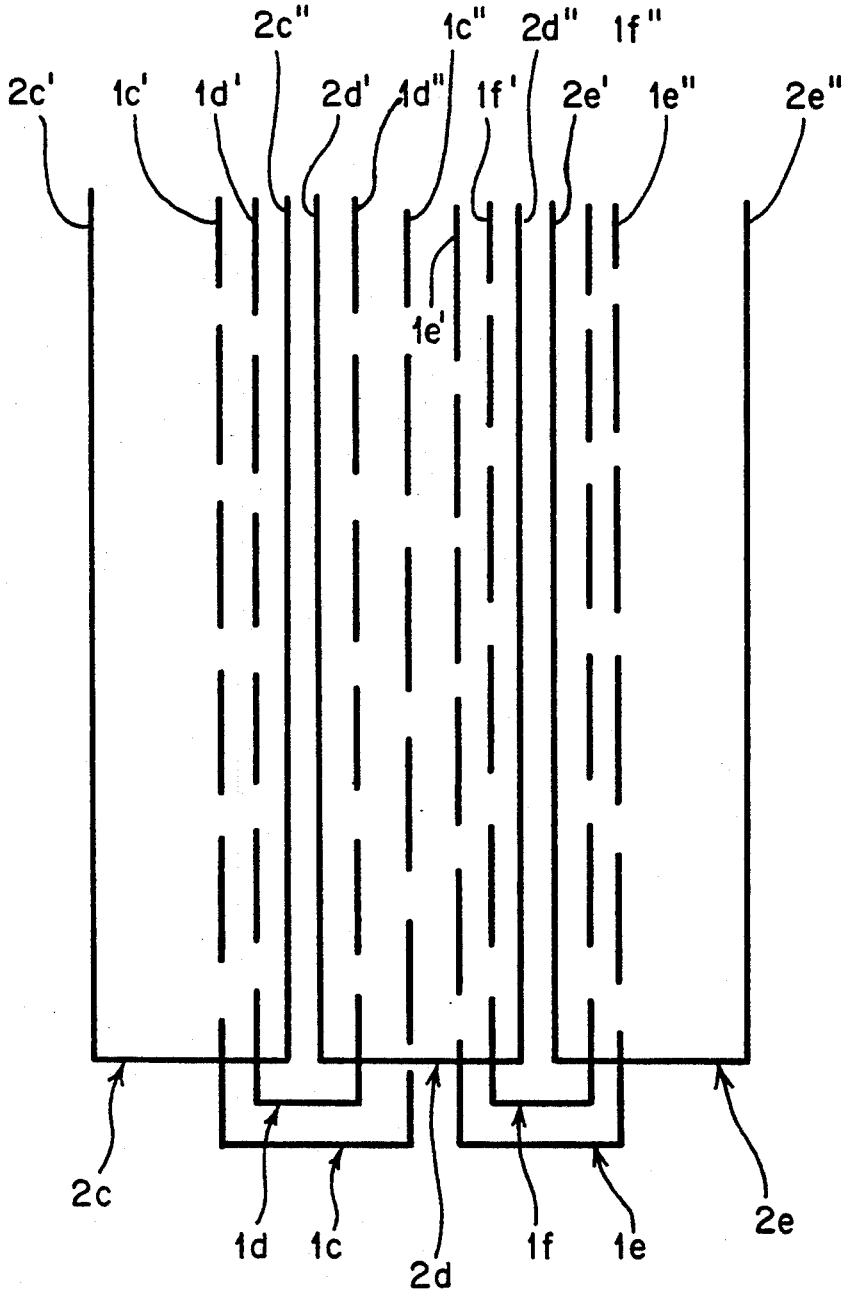

FIG. 4 shows the manner in which it is possible to produce a book of arbitrary thickness. The leaves 1*c'* and 1*d'* of sheets 1*c* and 1*d* are arranged between the leaves 2*c'* and 2*c''* of sheet 2*c*. The leaves 1*c''*, 1*d''*, 1*e'* and 1*f'* of sheets 1*c*, 1*d*, 1*e*, 1*f* are arranged between the leaves 2*d'* and 2*d''* of sheets 2*d*. Finally, the leaves 1*e''* and 1*f''* of sheets 1*e* and 1*f* are arranged between the sheets 2*e'* and 2*e''* of sheet 2*e*.

It is clear that the present invention is not limited to books, booklets and the like with rectangular leaves of even size.

I claim:

1. A book comprising a plurality of sheets, each sheet being folded in a zone constituting a back of the book along an axis of symmetry extending between two opposite edges of the sheets to provide a first leaf and a second leaf, at least one first one of the sheets having the first leaf thereof arranged between the two leaves of a second one of the sheets and the second leaf thereof arranged between the two leaves of a third one of the sheets, the first sheet having two cut-outs extending along the axis of symmetry from the opposite edges towards the center, and the second and third sheets having a slot-shaped cut-out extending along the axis of symmetry in the center, the leaves of the first sheet being insertable into the slot-shaped cut-outs in the second and third sheets.

2. The book of claim 1, comprising a first group of sheets comprised of the first sheets and a second group of sheets comprised of the second and third sheets.

3. The book of claim 2, comprising two outermost leaves belonging to the sheets of the second group.

4. The book of claim 1, comprising a plurality of said first sheets having the first leaves thereof arranged between the two leaves of the second sheets and the second leaves thereof arranged between the two leaves of the third sheets.

5. The book of claim 1, wherein the slot-shaped cut-outs are oval.

* * * * *